US007104468B2

(12) United States Patent
Stengel

(10) Patent No.: US 7,104,468 B2
(45) Date of Patent: Sep. 12, 2006

(54) PORTABLE SPRAY FAN

(75) Inventor: Ed Stengel, Owen Sound (CA)

(73) Assignee: VECTACOR (a division of Bonis & Company), Owen Sound (CA)

( * ) Notice: Subject to any disclaimer, the term of this patent is extended or adjusted under 35 U.S.C. 154(b) by 196 days.

(21) Appl. No.: 10/754,589

(22) Filed: Jan. 12, 2004

(65) Prior Publication Data

US 2005/0150976 A1 Jul. 14, 2005

(51) Int. Cl.

| | |
|---|---|
| ***A62C 13/62*** | (2006.01) |
| ***A62C 5/00*** | (2006.01) |
| ***B05B 15/00*** | (2006.01) |
| ***B05B 1/00*** | (2006.01) |

(52) U.S. Cl. ..... 239/302; 239/289; 239/600; 239/311; 239/314; 239/151; 239/333

(58) Field of Classification Search ..... 239/302, 239/289, 600, 311, 314, 151, 333; 222/383.1, 222/525, 175

See application file for complete search history.

(56) References Cited

U.S. PATENT DOCUMENTS

| | | | | |
|---|---|---|---|---|
| 4,839,106 | A * | 6/1989 | Steiner | 261/28 |
| 5,304,035 | A | 4/1994 | Carter | |
| 5,338,495 | A | 8/1994 | Steiner et al. | |
| 5,620,633 | A | 4/1997 | Junkel et al. | |
| 5,667,731 | A | 9/1997 | Junkel et al. | |
| 5,715,999 | A | 2/1998 | Hsu | |
| 5,752,662 | A | 5/1998 | Hsu | |
| 5,843,344 | A * | 12/1998 | Junkel et al. | 261/28 |
| 5,965,067 | A | 10/1999 | Junkel et al. | |
| 6,135,174 | A | 10/2000 | Neville | |
| 6,161,777 | A * | 12/2000 | Carter et al. | 239/222.11 |
| 6,179,564 | B1 | 1/2001 | Park | |
| 6,378,845 | B1 | 4/2002 | Hsu | |
| 6,398,132 | B1 | 6/2002 | Junkel et al. | |

* cited by examiner

*Primary Examiner*—Davis Hwu
(74) *Attorney, Agent, or Firm*—Marks & Clerk; Richard J. Mitchell

(57) ABSTRACT

Disclosed is a personal fan assembly comprising a spray bottle body for storing a liquid and having a nozzle for dispensing the liquid on demand in the form of a spray; and a fan unit releasably attachable to said spray bottle body. The fan unit includes an impeller to create an air stream, and the nozzle is located downstream of the impeller and to one side thereof out of the air stream. The nozzle is oriented at an angle to the air stream so as to direct the spray into the air stream at an angle. The spray bottle body may be in the shape of a U, with the opening in the horseshoe adapted to releasably receive the fan unit. Alternatively, the spray bottle body may be in the form of a water pitcher and the fan unit is mountable in a cylindrical housing within the spray bottle body.

16 Claims, 3 Drawing Sheets

PORTABLE SPRAY FAN

FIELD OF THE INVENTION

This invention relates to the field of portable fans, and in particular to a personal spray fan.

BACKGROUND OF THE INVENTION

There are many situations where it is desirable for a person to be able to carry a portable fan for personal cooling as they move about. For example, in fair grounds, theme parks, and the like, which are generally located in warm climates, a person strolling outside can find it unpleasantly hot, especially if the sun is beating down on gravel or hot tarmac.

U.S. Pat. No. 5,752,662 describes a personal spray fan. The device includes a spray body with a fan housing mounted over top. The spray nozzle is situated behind the fan hub and blades. The problem with such an arrangement is that the rotating fan vanes interrupt the spray, causing water to be scattered out of the airflow.

U.S. Pat. No. 5,843,344 describes another personal spray fan. The device includes a fan body releasably secured to the front face of a misting device body, so that the spray is above and behind the fan blades. This arrangement, while portable, is not suitable for wearing around the user's neck as a necklace. Also, the spray is not in the airflow produced by the rotating fan blades.

U.S. Pat. No. 6,378,845 describes a necklace spray fan. The device includes a fan body and spray body joined side by side along a longitudinal plane. Both the spray flow and the airflow are directed upwards. The user must grip and squeeze the spray body to release a spray. The problem with such an arrangement is the device must be manually positioned so that the airflow and spray are directed toward the user's face. This device can not be mounted in a stable position against the user so that the air and spray flow are directed toward the user's face. Also, the shroud interrupts the airflow and thus reduces efficiency, which is important in the case of battery-powered devices.

SUMMARY OF THE INVENTION

According to the present invention, there is provided a personal fan assembly comprising: a spray bottle body for storing a liquid and having a nozzle for dispensing said liquid on demand in the form of a spray; and a fan unit releasably attachable to said spray bottle body, said fan unit including an impeller to create an air stream; said nozzle being located downstream of said impeller and to one side thereof out of said air stream, and said nozzle being oriented at an angle to said air stream so as to direct said spray into said air stream at an angle.

Such a fan has the advantage that the fan blades or hub does not obstruct the spray. Also, with the arrangement of the inventive device, the spray is directed into the air stream or airflow so that the spray is efficiently carried by the airflow.

The avoidance of a shroud or grill means that the airflow is uninterrupted, and the fan is therefore much more efficient.

In one embodiment, the fan may include a cord so that the fan can be worn around a user's neck and be stably mounted on the wearer's chest. As a result the wearer can accurately direct the airflow onto a specific location, such as his or her face.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein.

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like specifically recited herein.

DETAILED DESCRIPTION OF THE PREFERRED EMBODIMENTS

Figure 1:
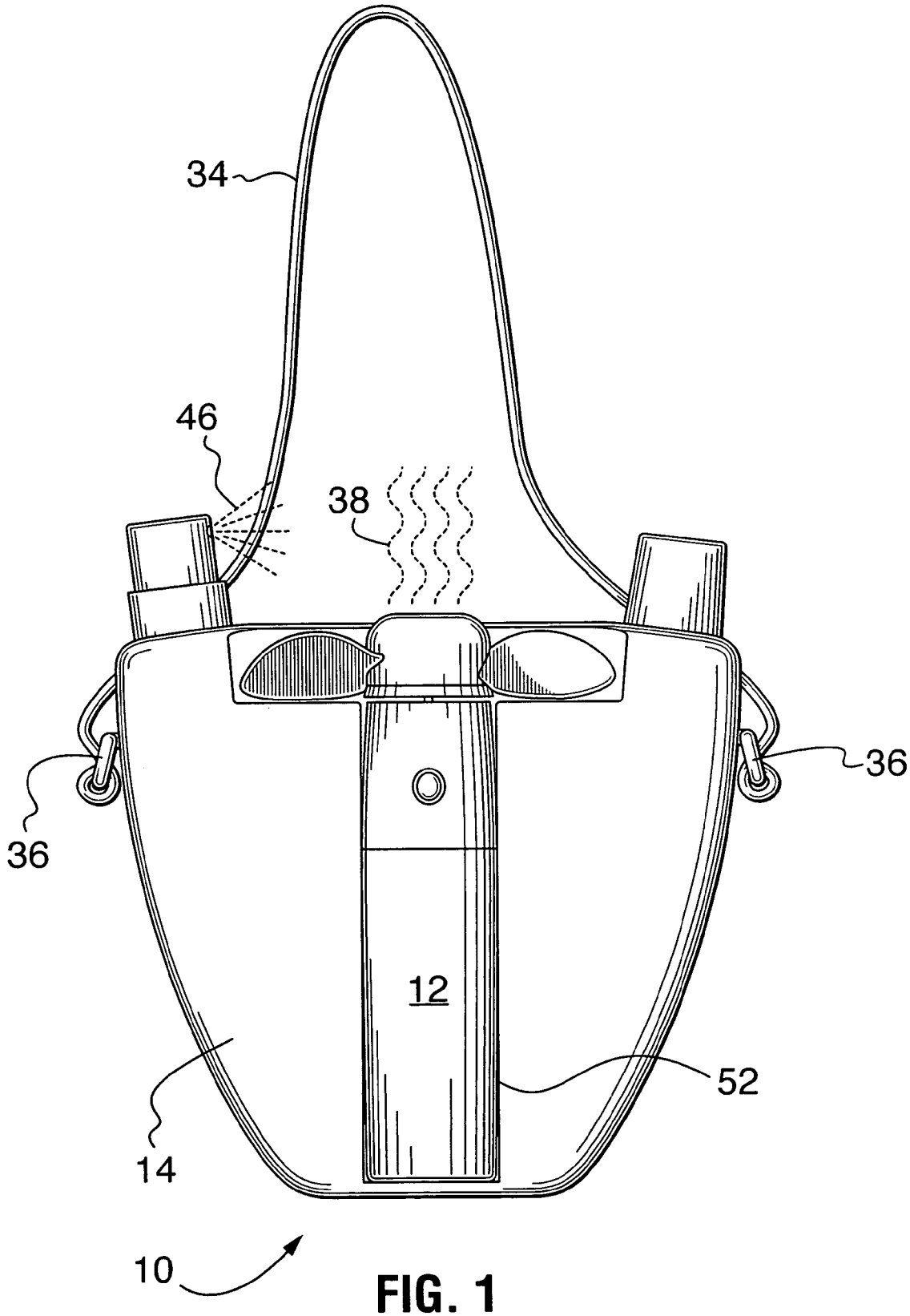
FIG. 1 is an elevational view of a portable spray fan assembly according to principles of the present invention.
Figure 2:
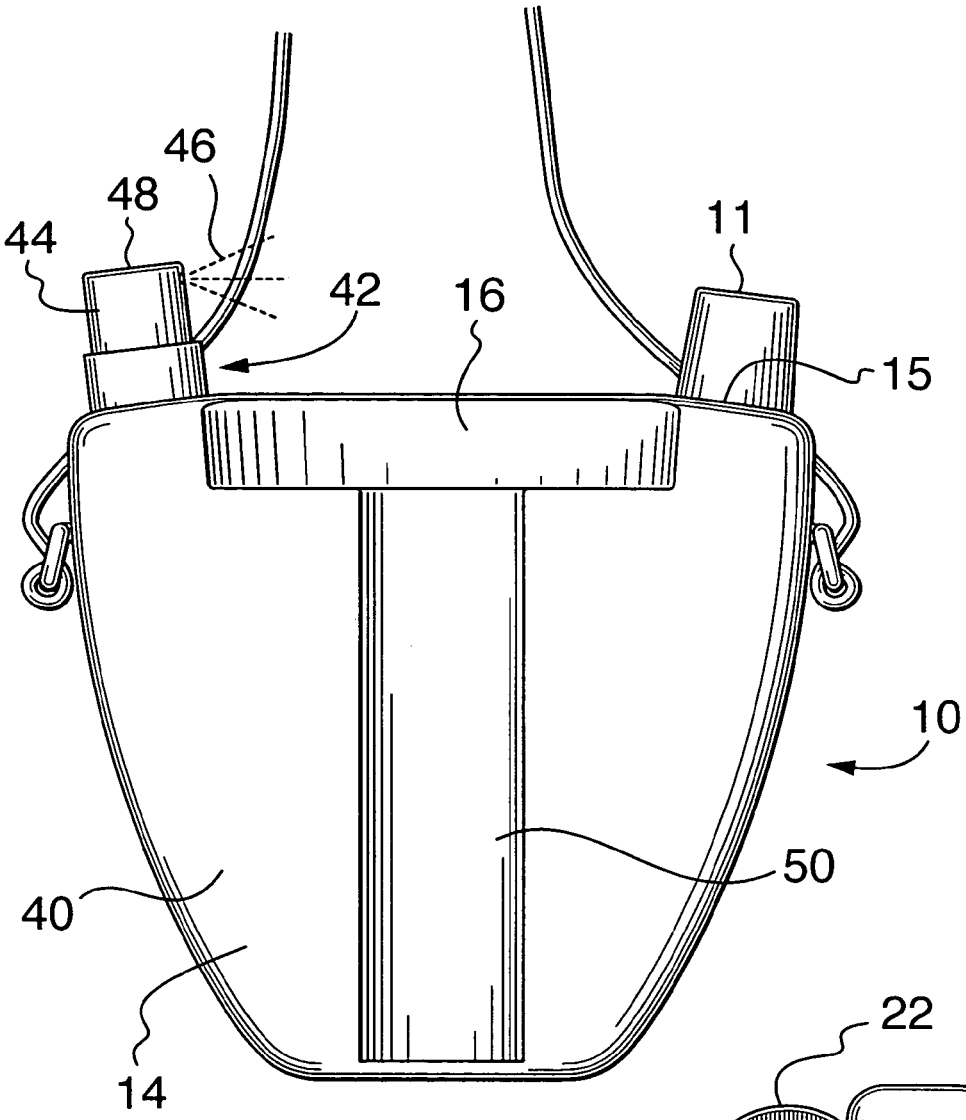
FIG. 2 illustrates the spray bottle body of the spray fan assembly of FIG. 1.
Figure 3:
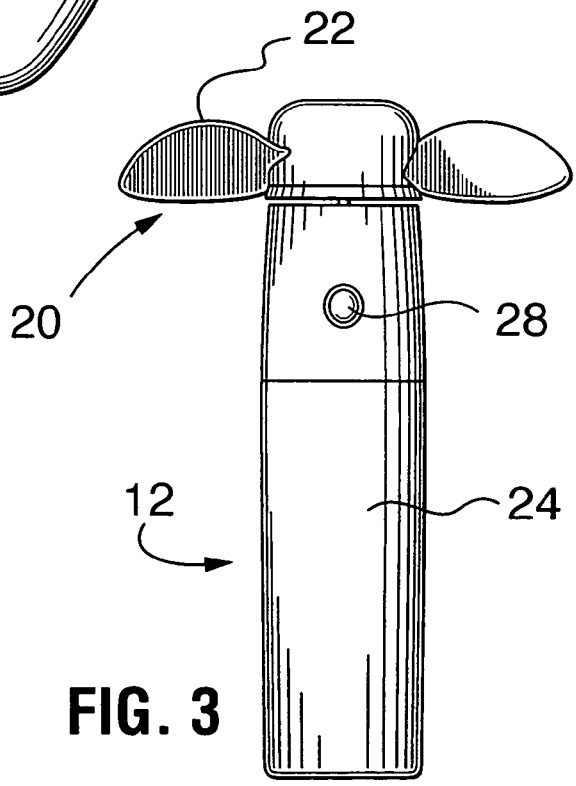
FIG. 3 illustrates the fan unit of the spray fan assembly of FIG. 1.

Referring to FIGS. 1 to 3, the portable spray fan 10 in accordance with the principles of the invention has a spray bottle body 14. The spray bottle body 14 may generally be in the shape of an inverted U constructed of a durable plastic. The spray bottle body 14 defines a water reservoir 40 having a delivery tube (not shown) therein. One end of the delivery tube is connected to a nozzle assembly 42. Nozzle 44 is directed to provide a spray of water 46 upstream of the air stream or airflow 38 produced by the impeller 20 (described below). The nozzle 44 is fastened to a push button knob 48 to allow water from the spray bottle body 14 to be expelled from the nozzle 44 when the knob 48 is activated by pushing down thereon. Alternatively, the actuator may be a pressure trigger type of actuator. A user has to loosen the knob 48 prior to putting water into the spray bottle body 14.

The spray bottle body 14 includes a mounting base portion 16. The opposite side of the spray bottle body defines an opening 50 that receives a fan unit 12. The fan unit 12 has an impeller 20 consisting of rotatable fan blades 22 and a fan housing 24. The fan blades 22 are made of soft rubbery material so that they do not cause injury on impact. Such fan blades are well known in the art.

Controls 28 are also located on the fan housing 24. The controls can control the operation of the fan unit. For example, they can include an on-off switch and, if desired, a speed control.

Power for the fan unit can be supplied by batteries and motor (not shown), which are normally located inside the hollow fan housing 24.

The spray bottle body 14 is attached to the fan unit 12 by a fastening means 52 to form the spray fan 10. Any suitable means of fastening may be used. Preferably, the fan unit 12 is held within the spray bottle body 14 by a friction fit. Alternatively, the fastening means could comprise a keyhole arrangement. In this case, the fan unit may include keys that fit into keyholes in a corresponding abutting surface of the spray bottle body. Alternatively, it should be noted that the fan unit 12 may be used without the spray bottle body.

Preferably a neck strap 34 is attached by removable clips 36 to opposite ends of the mounting body portion 16 of the spray bottle body to form a closed-loop therearound. The neck strap 34 may include a safety release (not shown). The neck strap enhances portability of the spray fan. The user may wear the necklace spray fan with the mounting base portion 16 lying against the wearer's chest. The side lying against the chest may be flat, or may be contoured to match the shape of a human chest. The mounting base portion 16 also serves to keep the rotating fan blades clear of the user's body.

In use, the fan directs airflow 38 in a particular direction, and the nozzle 44 directs spray 46 into the airflow upon activation of the knob 48. With the neck strap, the necklace spray fan 10 hangs around the user's neck such that the fan unit directs airflow to the user's face, and the nozzle 44 directs spray 46 into the airflow upon activation of the knob 48 so that the user receives a fine mist on his/her face in a consistent manner as the user moves about.

The spray bottle body 14 also includes a screw cap 11 on the top portion 15 thereof. The screw cap 11 can be unthreaded and removed to reveal an opening to allow a user to fill the reservoir 40. Preferably, the opening is large enough to allow ice cubes to be inserted into the reservoir 40. The screw cap 11 preferably has a pull-up nipple (not shown) to allow a user to drink from the spray bottle body 14.

Figure 4:
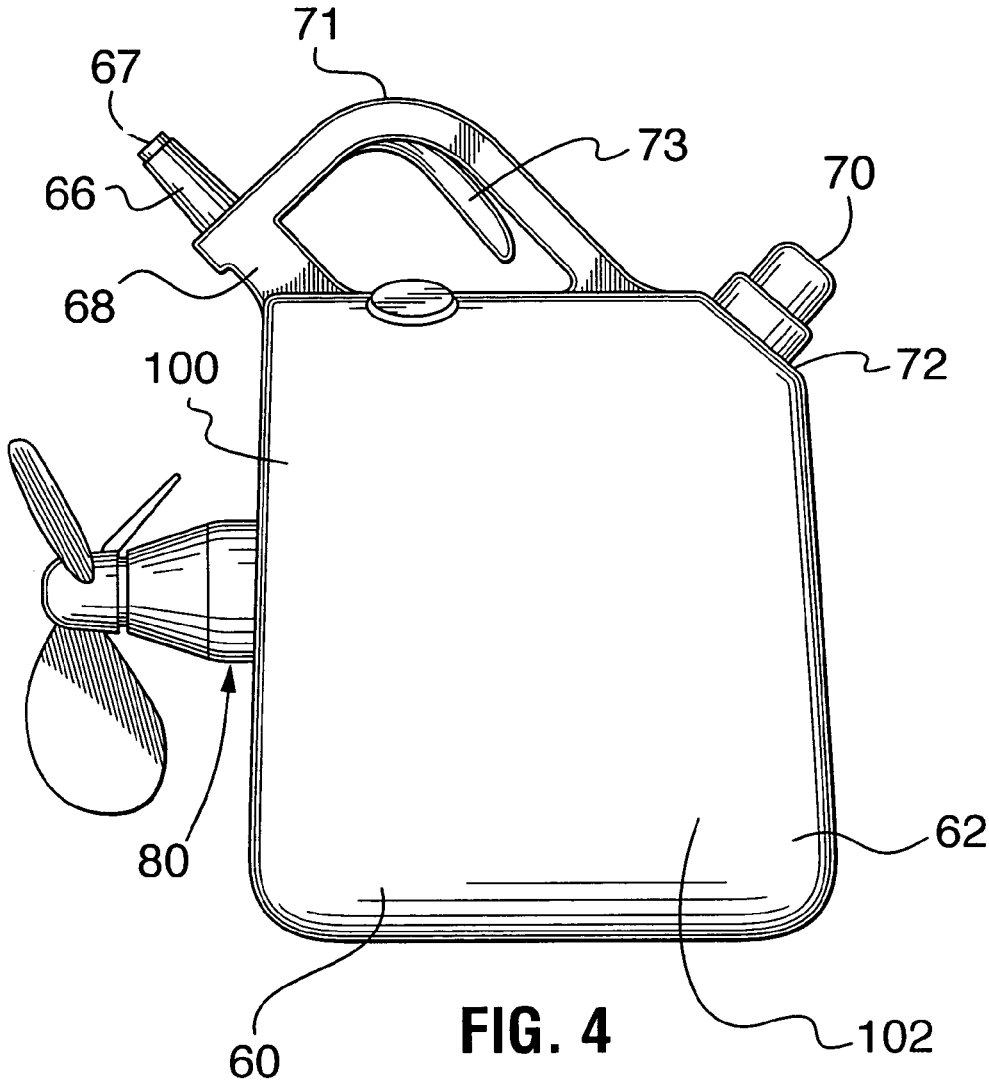
FIG. 4 is an elevational view of another embodiment of a portable spray fan in accordance with principles of the present invention.
Figure 5:
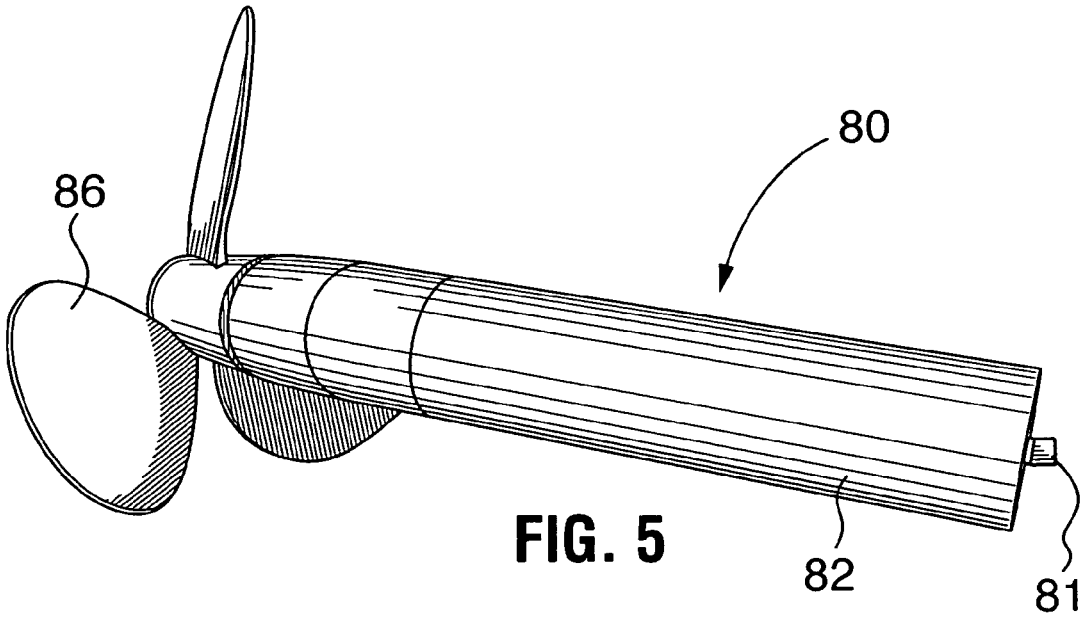
FIG. 5 illustrates the fan body of the fan of FIG. 4.

Referring to FIGS. 4 and 5, another embodiment of a portable spray fan 60 is illustrated. In this embodiment, the spray bottle body 62 is generally in the form of a water pitcher having a neck portion 68 and a handle 71. The spray bottle body 62 defines a water reservoir 102 having a delivery tube (not shown) therein. One end of the delivery tube is connected to a nozzle 66 fixed to the elongated neck portion 68 of the spray bottle body 62. Preferably, the nozzle 66 is a standard spray nozzle with a push button actuator 67. In the embodiment shown, there is also a pressure trigger 73 mounted to the handle 71 for dispensing a spray from nozzle 66.

The spray bottle body 62 also includes a screw cap 70 on the top portion 72 thereof. The screw cap 70 can be unthreaded and removed to reveal an opening to allow a user to fill the reservoir 102. Preferably, the opening is large enough to allow ice cubes to be inserted into the reservoir 102. The screw cap 70 preferably has a pull-up nipple (not shown) to allow a user to drink from the spray bottle body 62.

The fan unit 80 comprises an elongate housing 82 with an impeller 86 on one end. There is also a switch 81, which is a power on/off switch, and may also include other controls, such as a speed control. Power for the fan unit can be supplied by batteries and motor (not shown), which are normally located inside the hollow housing 82.

The spray bottle 62 body defines a cylindrical housing 100 within the reservoir 102 for receiving the fan unit 80. For insertion, the fan unit 80 is slid into the housing 100 in the spray bottle body 62. When inserted, the on/off switch (not shown in FIG. 4) is located outside said container 62. Preferably, the fan unit 80 is elliptical and has a friction fit that bottoms-out in the housing 100.

In use, the impeller 86 directs airflow in a particular direction, and the nozzle 66 directs spray into the airflow.

In one embodiment, the fan assembly 60 may also include a carrying strap (not illusrated) attached by removable clips to the spray bottle body to form a closed-loop therearound. The carrying strap may include a safety release. The carrying strap enhances portability of the fan.

Numerous modifications may be made without departing from the spirit and scope of the invention as defined in the appended claims.

What is claimed is:

1. A personal fan assembly comprising:

a spray bottle body for storing a liquid and having a nozzle for dispensing said liquid on demand in the form of a spray; and a self-contained fan unit having a main body portion received within an opening in said spray bottle body and being removable from said spray body for use in a stand-alone configuration, said fan unit including an exposed impeller to create an axial air stream;

said nozzle being located at a point downstream of said impeller in relation to said axial air stream and to one side of said impellter out of said axial air stream, and said nozzle being oriented at an angle to said axial air stream so as to direct said spray into said axial air stream at a forward angle.

2. The personal fan assembly of claim 1, wherein the spray bottle body is releasably engaged with said fan unit by a friction fit.

3. The personal fan assembly of claim 1, further comprising a drinking nipple communicating with the interior of said spray bottle body.

4. The personal fan assembly of claim 1, further comprising a battery for powering said fan unit located within a housing forming part of the fan unit.

5. The personal fan assembly of claim 1, wherein said spray bottle body comprises a portable container with said impeller located at one side thereof.

6. The personal fan assembly of claim 5, wherein said fan unit is removably accommodated within a cylindrical housing extending within said container.

7. The personal fan assembly of claim 6, wherein said impeller protrudes from said container, and said nozzle overhangs said protruding impeller.

8. The personal fan assembly of claim 6, wherein an on/off switch is located outside said container when said fan unit is accommodated in said housing.

9. The personal fan assembly of claim 6, further comprising a carrying handle integral within said container.

10. The personal fan assembly of claim 9, further comprising a drinking nipple communicating with the interior of said container.

11. The personal fan assembly of claim 10, wherein said container is generally rectangular with said impeller at one end thereof.

12. A personal fan assembly comprising: a spray bottle body for storing a liquid and having a nozzle for dispensing said liquid on demand in the form of a spray; and a fan unit releasably attachable to said spray bottle body, said fan unit including an impeller to create an air stream; said nozzle being located downstream of said impeller and to one side thereof out of said air stream, and said nozzle being oriented at an angle to said air stream so as to direct said spray into said air stream at an angle, and further comprising a cord to permit the personal fan assembly to be suspended around the neck of a wearer, and a mounting base portion on one side of the spray bottle body and adapted to lie snugly against the chest of the wearer such that in use the impeller is oriented generally upward toward the wearer's face.

13. The personal fan assembly of claim 12, wherein said mounting base portion is contoured to match the shape of the wearer's chest.

14. The personal fan assembly of claim 12, wherein the spray bottle body is generally in the shape of an inverted U that mates with the fan unit, said fan unit having a complementary shape to the spray bottle body.

15. The personal fan assembly of claim 12, wherein said nozzle is oriented such that in use when the fan assembly is suspended around the wearer's neck said spray is directed generally into the air stream.

16. A personal fan assembly comprising:

a spray bottle body for storing a liquid and having a nozzle for dispensing said liquid on demand in the form of a spray; and a fan unit attached to said spray bottle body and being releasable for use in a stand-alone configuration, said fan unit including an impeller to create an axial air stream;

said nozzle being located at a point out of said axial air stream to one side of said impeller, and downstream of said impeller in relation to said axial air stream, and said nozzle being oriented at an angle to said axial air stream so as to direct said spray into said air stream at a forward angle.

* * * * *